US005278745A

United States Patent [19]

Kelly et al.

[11] Patent Number: 5,278,745

[45] Date of Patent: Jan. 11, 1994

[54] APPARATUS AND METHOD FOR PIVOTABLY ATTACHING A REFRACTOR TO A REFLECTOR IN A LIGHTING FIXTURE

[75] Inventors: Rick M. Kelly; John C. McCartney, both of Newark; Donald N. Colangelo, Heath, all of Ohio

[73] Assignee: Holophane Company, Inc., Newark, Ohio

[21] Appl. No.: 935,817

[22] Filed: Aug. 26, 1992

[51] Int. Cl.[5] ..... F21V 21/00

[52] U.S. Cl. ..... 362/374; 362/308; 362/311

[58] Field of Search ..... 362/311, 308, 310, 374, 362/375, 396

[56] References Cited

U.S. PATENT DOCUMENTS

| | | | |
|---|---|---|---|
| 2,271,162 | 1/1942 | Sorrell | 362/374 |
| 2,344,327 | 3/1944 | Runge | 362/374 |
| 2,861,711 | 11/1958 | Schneider | 362/374 |
| 2,899,542 | 8/1959 | Mauro | 362/374 |
| 3,069,541 | 12/1962 | Thomsen et al. | 362/374 |
| 3,093,322 | 6/1963 | Boutelle | 362/311 |
| 3,328,579 | 6/1967 | Green | 362/375 |
| 4,516,196 | 5/1985 | Blake | 362/311 |
| 4,654,768 | 3/1987 | Dryman et al. | 362/374 |
| 4,674,012 | 6/1987 | Olmos | 362/396 |
| 4,969,072 | 11/1990 | Pye | 362/310 |

FOREIGN PATENT DOCUMENTS

| | | | |
|---|---|---|---|
| 0648530 | 7/1937 | Fed. Rep. of Germany | 362/374 |

*Primary Examiner*—Richard R. Cole
*Assistant Examiner*—Alan B. Cariaso
*Attorney, Agent, or Firm*—Brooks & Kushman

[57] ABSTRACT

An apparatus for allowing pivotal movement between a reflector of a lighting fixture and a refractor which extends across an opening in the reflector is disclosed. The apparatus comprises a body portion, a leg portion attached to the body portion, and a retention portion attached to the body portion. The leg portion includes a pair of legs spaced apart from each other, which are closable against an inner surface of the reflector to secure the apparatus to the reflector. The retention portion includes a pair of retainers, each of which is closable around a bolt of the refractor to retain the bolt and allow pivotal movement of the refractor with respect to the reflector.

3 Claims, 2 Drawing Sheets

APPARATUS AND METHOD FOR PIVOTABLY ATTACHING A REFRACTOR TO A REFLECTOR IN A LIGHTING FIXTURE

TECHNICAL FIELD

This invention relates to hinges for allowing pivotal movement between the reflector and the refractor of a high intensity discharge lighting fixture, and more particularly to such a hinge which is attached to the reflector without the use of fasteners or adhesives.

BACKGROUND ART

High intensity discharge (HID) lighting fixtures have widespread application in commercial, industrial, and institutional buildings. Conventional HID lighting fixtures generally include reflectors which enclose high intensity discharge lamps. Light emitted from such lamps is redirected by the reflectors in cooperation with refractors which are typically situated over openings at the bottom of the reflectors.

Conventional refractors of the type discussed above are typically joined to the corresponding reflector through the use of a hinge. The hinge allows the refractor to be moved away from the reflector, thereby providing access to the interior of the reflector to change the lamp and perform other routine maintenance. See, for example, U.S. Pat. No. 4,654,768 to Dryman et al. which discloses a luminaire including a device for hingedly mounting the refractor on a rim of the reflector. The device disclosed by Dryman et al. includes a bracket connected to the reflector and a hinge clip connected to a clampband around the refractor. The bracket has two hooked extensions which engage slotted sections of the hinge clip.

While Dryman et al. does not disclose how the bracket is connected to the reflector, those skilled in the art will appreciate that fasteners such as screws or rivets are normally employed to form this connection. The use of screws or rivets, however, significantly adds to the cost of materials and time required to assemble the corresponding lighting fixtures.

SUMMARY OF THE INVENTION

The present invention is a novel apparatus for allowing pivotal movement between a reflector of a lighting fixture and a refractor which extends across an opening in the reflector. The apparatus comprises a body portion, a leg portion attached to the body portion, and a retention portion attached to the body portion. The leg portion includes a pair of legs spaced apart from each other, which are closable against an inner surface of the reflector to secure the apparatus to the reflector. The retention portion includes a pair of retainers, each of which is closable around a bolt of the refractor to retain the bolt and allow pivotal movement of the refractor with respect to the reflector.

Accordingly, it is an object of the present invention to provide an apparatus of the type described above which reduces the cost of materials and time required to assemble a lighting fixture.

Another object of the present invention is to provide an apparatus of the type described above which can be attached to a lighting fixture without the use of fasteners or adhesives.

Another object of the present invention is to provide an apparatus of the type described above that is attached to a lighting fixture by permanently deforming a section of the lighting fixture into a hole or slot existing in the apparatus.

Still another object of the present invention is to provide an apparatus of the type described above that does not penetrate the reflector when attached thereto, and therefore eliminates a potential source of water leakage into the interior of the reflector.

Yet still another object of the present invention is to provide a method of pivotably attaching a refractor to a reflector in a lighting fixture using an apparatus of the type described above.

These and other objects, features, and advantages of the present invention are readily apparent from the following detailed description of the best mode for carrying out the invention when taken in conjunction with the accompanying drawings.

BEST MODE FOR CARRYING OUT THE INVENTION

Figure 1:
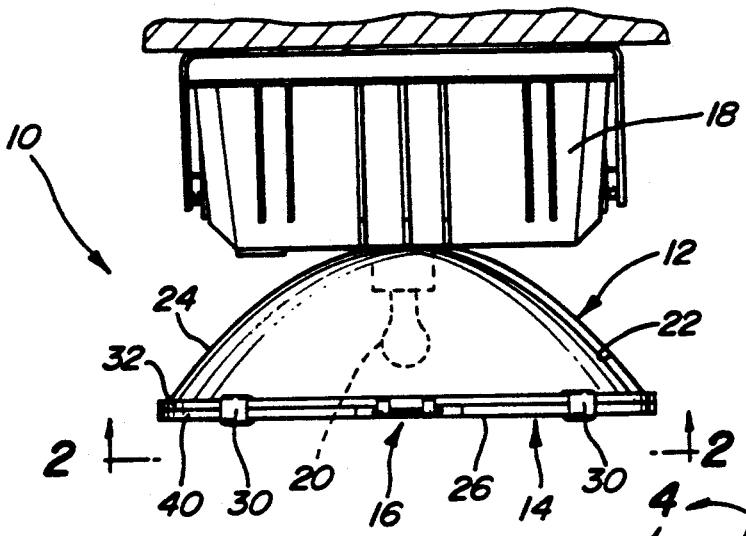
FIG. 1 is a side elevational view of a lighting fixture including a high intensity discharge lamp and a hinge according to the present invention for pivotably attaching a reflector to a refractor.
Figure 2:
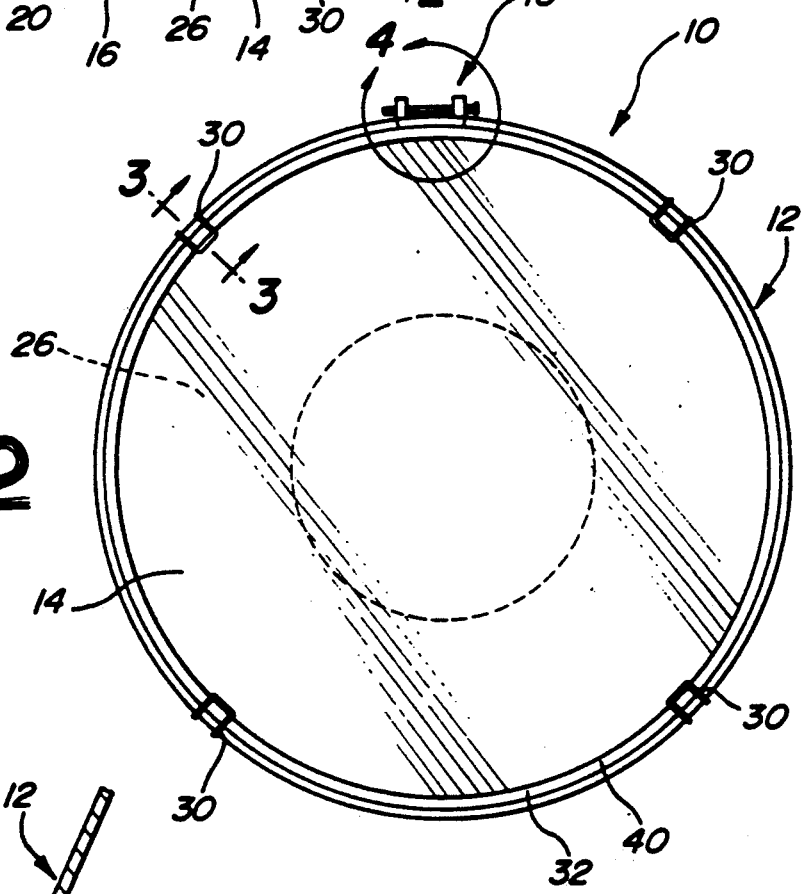
FIG. 2 is a bottom elevational view of the lighting fixture of FIG. 1 taken along line 2—2.

With reference to the drawings, the preferred embodiments of the present invention will be described. FIGS. 1 and 2 show a luminaire or lighting fixture 10 which can be suspended from a ceiling or otherwise mounted in conventional fashion to provide lighting to a corresponding work area. Lighting fixture 10 is capable of receiving a high intensity discharge (HID) lamp, and comprises a reflector 12, a refractor 14, and a hinge 16 according to the present invention. A housing 18 is also provided atop the reflector 12, and includes a conventional ballast assembly (not shown) to supply suitable electrical power to the HID lamp 20. As is well known in the art, the HID lamp 20 may be for example of the mercury, halide, high pressure sodium, or low pressure sodium type.

Still referring to FIGS. 1 and 2, reflector 12 is shown having an inner surface 22, an outer surface 24, and a generally circular opening 26 through which light may be emitted from the high intensity discharge lamp 20. The reflector 12 is preferably formed from aluminum, but may also be formed from any non-brittle material which may properly be deformed to provide the necessary support as described below. The inner surface 22 of the housing 12 is preferably anodized, and is adapted to reflect light through the opening 26.

The refractor 14, which may also be referred to as a lens, extends across and covers or envelopes the opening 26 of the reflector 12. Those skilled in the art will recognize that the physical design of refractor 14 may have varying degrees of complexity, depending upon the application for which the lighting fixture 10 is intended. For example, in simple applications, refractor 14 may comprise a flat light-transmissible window designed only to keep dirt and water out of the interior of the reflector 12. In more complex applications, however, refractor 14 may comprise discretely shaped glass or impact resistant plastic members designed to block and redirect specific light arrays.

Figure 3:
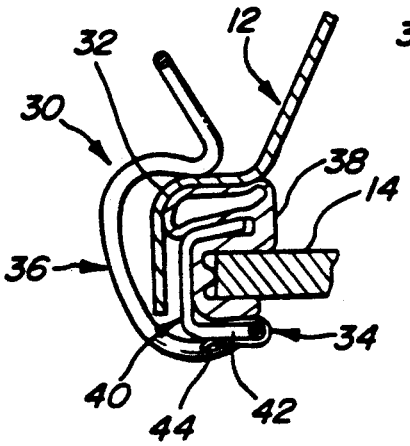
FIG. 3 is a cross-sectional view taken along line 3—3 of a latch of the lighting fixture.

Referring now to FIG. 3, there is shown one of a plurality of latch assemblies 30 that are spaced equilangularly around the circumference of reflector opening 26. Preferably, four of the latch assemblies 30 are arranged to secure the refractor 14 to a concave rim 32 of the reflector 12. The latch assemblies 30 hold the refractor 14 in a closed position when the lighting fixture 10 is in operation.

Each latch assembly 30 includes a latch clip 34 and a wire latch 36, both of which are preferably comprised of steel or other material having similar strength and corrosion resistant properties. An elastomeric door gasket 38 is arranged about the perimeter of the refractor 14, and is held in place by a door 40, which is preferably comprised of aluminum or other soft metal amenable to being crimped around a portion of the door gasket 38 and the edge of the refractor 14. The U-shaped latch clip 34 fits around a flange 42 of the door 40 such that a flared end 44 of the latch clip 34 projects away from the plane defined by the refractor 14.

The latch 36 is disposed about the latch clip 34 and the rim 32 of the reflector 12, and engages the flared end 44 of the latch clip 34 to hold the refractor 14 to the reflector 12. The latch 36 is easily manually disengaged to allow the refractor 14 to separate from the reflector 12, thus permitting access to the interior of the reflector 12 for relamping or other maintenance. After the relamping operation is completed, the latches 36 are simply reengaged around the perimeter of the refractor 14 and the rim 32 for continued operation.

Figure 4:
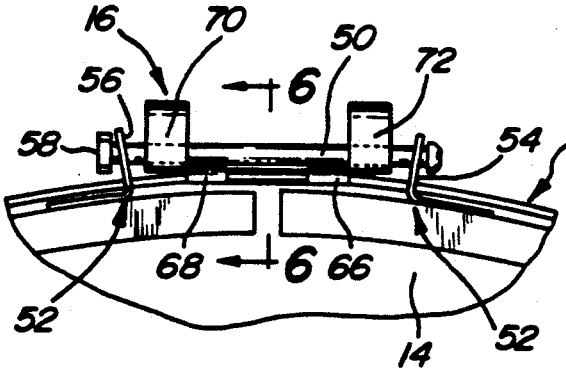
FIG. 4 is an enlarged view of the area designated 4 in FIG. 2.

FIG. 4 shows in more detail the hinge 16 which allows the refractor 14 to pivot with respect to the reflector 12 when the latches 36 are removed. Attention is directed to bolt 50 which is attached rigidly to the door 40, which in turn extends around the refractor 14. The bolt 50 fits through a mounting bracket 52 which preferably includes opposite flanges 54 and 56. Each of the flanges 54 and 56 is attached to the perimeter of the door 40 by rivets (not shown), and includes a receiving hole through which bolt 50 extends. A nut 58 secures the bolt 50 in place such that bolt 50 extends generally tangentially to reflector opening 26. The bolt 50 thus forms a hinge pin and provides an axis about which the hinge 16 may rotate, as more fully described below. It should be appreciated that any structure that functions as a hinge pin may be substituted for the bolt 50, such as a rivet, pin, or strip of sheet metal.

Referring now to FIGS. 5 through 8, the construction and operation of hinge 16 is shown in further detail. The hinge 16 is preferably stainless steel, and includes a body portion 60, a leg portion 62, and a retention portion 64. The body portion 60 is bent at about a ninety degree (90°) angle, and is integrally formed with both the leg portion 62 and the retention portion 64. The leg portion 62 further includes a pair of legs 66 and 68 spaced apart from each other. Each of the legs 66 and 68 is integrally attached to the body portion 60, and is closable against the inner surface 22 of the reflector 12 to secure the hinge 16 to the reflector 12.

The retention portion 64 further includes a pair of retainers 70 and 72 spaced apart from each other which define therebetween a slot 74. Each of the retainers 70 and 72 is attached to the body portion 60 of the hinge 16 on opposite sides of the leg portion 62. The retainers 70 and 72 are preferably longer than the legs 66 and 68, and about the same width. Each of the retainers 70 and 72 is independently closable around the bolt 50 of the refractor 14 to retain the bolt 50 and allow pivotal movement of the refractor 14 with respect to the reflector 12.

Figure 5:
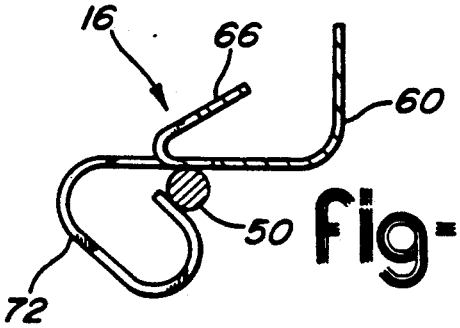
FIG. 5 is a cross-sectional view of the hinge showing a leg portion and a retention portion in their open positions.
Figure 6:
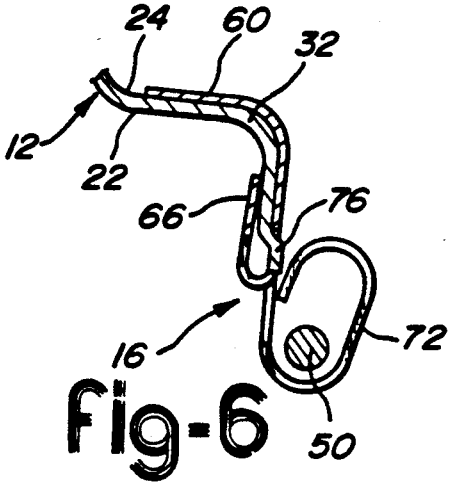
FIG. 6 is a cross-sectional view of the hinge showing the leg portion and the retention portion in their closed positions.
Figure 7:
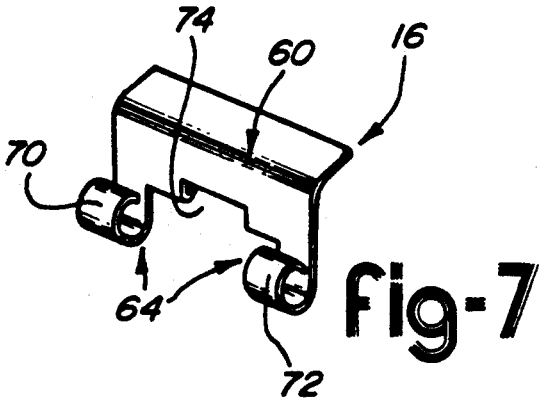
FIG. 7 is a perspective view of one side of the hinge.
Figure 8:
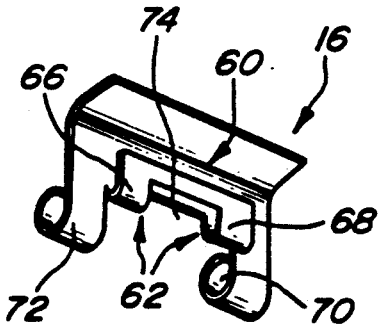
FIG. 8 is a perspective view of the other side of the hinge.

As best shown in FIG. 5, the legs 66 and 68 and the retainers 70 and 72 of the hinge 16 are initially in an open position. Thereafter, the bolt 50 is drawn inside the loops formed by the retainers 70 and 72. As shown in FIG. 6, the legs 66 and 68 are then closed against the inner surface 22 of the reflector 12. Retainers 70 and 72 are similarly closed back against themselves to encircle the bolt 50. When the hinge 16 is in place as shown in FIG. 6, the body portion 60 of the hinge 16 abuts the outer surface 24 of the reflector 12, and may optionally be spot welded or otherwise connected thereto.

The legs 66 and 68 are preferably closed by conventional pneumatic pliers. One set of jaws of the pneumatic pliers is placed to close the legs 66 and 68, while at the same time a second set of jaws is rested in the gap between the legs 66 and 68. When the pneumatic pliers are forced shut, the second set of jaws operates to deform a section 76 of the rim 32 of the reflector 12 through the slot 74.

The resulting connection of the legs 66 and 68 around the reflector 12 and the deformed section 76 through the slot 74 secures the hinge 16 to the reflector 12 without the use of fasteners or adhesives. Because the reflector 12 is not penetrated by the hinge 16, for applications where the lighting fixture 10 is used in a location subject to rain or other moisture, a source of water leakage into the interior of the reflector 12 is eliminated. Relative lateral movement or sliding between the hinge 16 and the reflector 12 is also inhibited, while pivotal movement between the reflector 12 and the refractor 14 is permitted. It should be appreciated that as long as the slot 74 exists for the section 76 to be deformed through, the legs 66 and 68, and the retainers 70 and 72, can be joined across their free ends without affecting the operation of the present invention. This might be desirable, for instance, if the hinge 16 is punched out of sheet metal stock.

In accordance with the above description, a method of pivotably attaching a refractor to a reflector in a lighting fixture of the type described herein is apparent. Initially, a hinge having a body portion, a retention portion attached to the body portion, a leg portion attached to the body portion, and a slot formed in the leg portion is provided. The leg portion of the hinge is then closed against an inner surface of the reflector, and a section of a rim of the reflector is deformed through the slot in the hinge. Preferably, the leg portion is closed and the section of the reflector is deformed at the same time by pneumatic pliers, as described above. Either before, during, or after this operation, the retention portion of the hinge is closed around a bolt attached to the refractor to permit the refractor to pivot with respect to the reflector.

It should be understood that while the forms of the invention herein shown and described constitute preferred embodiments of the invention, they are not intended to illustrate all possible forms thereof. It should also be understood that the words used are words of description rather than limitation, and various changes may be made without departing from the spirit and scope of the invention disclosed.

What is claimed is:

1. Apparatus for allowing pivotal movement between a reflector of a lighting fixture and a refractor which extends across an opening in the reflector, the reflector having an inner surface, the refractor having a bolt attached thereto, the apparatus comprising:

a body portion;

a leg portion attached to the body portion, the leg portion being closable against the inner surface of the reflector to secure the apparatus to the reflector, said leg portion having a slot defined there through and adapted to receive a section of said reflector; and a pair of retainers spaced apart from each other, each of the retainers being attached to the body portion on opposite sides of the leg portion and independently closable around the bolt of the refractor to retain the bolt and allow pivotal movement of the refractor with respect to the reflector.

2. A lighting fixture, comprising:

a reflector having an inner surface and an opening through which light may be emitted;

a refractor for covering the opening of the reflector, the refractor having a bolt attached thereto; and a hinge for allowing pivotal movement between the reflector and the refractor, the hinge including a body portion, a leg portion attached to the body portion, and a pair of retainers spaced apart from each other, each of the retainers being attached to the body portion on opposite sides of the leg portion and independently closable around the bolt of the refractor to retain the bolt and allow pivotal movement of the refractor with respect to the reflector, the leg portion further including a slot defined therein and being closed against the inner surface of the reflector while receiving a section of the reflector so as to secure the hinge to the reflector.

3. A lighting fixture, comprising:

a reflector having an inner surface, an outer surface, and an opening through which light may be emitted;

a refractor for covering the opening of the reflector, the refractor having a bolt attached rigidly thereto; and a hinge for allowing pivotal movement between the reflector and the refractor, the hinge having a body portion abutting the outer surface of the reflector, a pair of legs spaced apart from each other, a pair of retainers spaced apart from each other, and a slot defined between the pair of legs, the slot being adapted to receive therethrough a section of the reflector to secure the hinge to the reflector, each of the legs being attached to the body portion and closed against the inner surface of the reflector to secure the hinge to the reflector, each of the retainers being attached to the body portion on opposite sides of the leg portion and independently closed around the bolt of the refractor to retain the bolt and allow pivotal movement of the refractor with respect to the reflector.

* * * * *